US007014054B2

(12) United States Patent
Yahiaoui et al.

(10) Patent No.: US 7,014,054 B2
(45) Date of Patent: Mar. 21, 2006

(54) OVERTURNING MOMENT MEASUREMENT SYSTEM

(75) Inventors: Mohamed Yahiaoui, Hazard, KY (US); Brian Michael Boeckman, Chambersburg, PA (US)

(73) Assignee: JLG Industries, Inc., McConnellsburg, PA (US)

( * ) Notice: Subject to any disclaimer, the term of this patent is extended or adjusted under 35 U.S.C. 154(b) by 0 days.

(21) Appl. No.: 10/184,873

(22) Filed: Jul. 1, 2002

(65) Prior Publication Data

US 2004/0000530 A1 Jan. 1, 2004

(51) Int. Cl.
*B66C 15/00* (2006.01)

(52) U.S. Cl. ..... 212/277; 212/270; 212/278

(58) Field of Classification Search ..... 212/278, 212/277, 270
See application file for complete search history.

(56) References Cited

U.S. PATENT DOCUMENTS

| | | | | |
|---|---|---|---|---|
| 3,035,528 | A * | 5/1962 | Bolton | 104/44 |
| 3,638,211 | A | 1/1972 | Sanchez | |
| 3,641,551 | A | 2/1972 | Sterner et al. | |
| 3,695,096 | A | 10/1972 | Kutsay | |
| 3,713,129 | A | 1/1973 | Buchholz | |
| 3,737,888 | A * | 6/1973 | Cheze | 340/685 |
| 3,740,534 | A | 6/1973 | Kezer et al. | |
| 3,871,528 | A | 3/1975 | Wilkinson | |
| 4,042,135 | A | 8/1977 | Pugh et al. | |
| 4,743,893 | A | 5/1988 | Gentile et al. | |
| 4,752,012 | A | 6/1988 | Juergens | |
| 4,815,614 | A | 3/1989 | Putkonen et al. | |
| 4,895,262 | A | 1/1990 | Maso | |
| 5,058,752 | A | 10/1991 | Wacht et al. | |
| 5,160,055 | A | 11/1992 | Gray | |
| 5,359,516 | A | 10/1994 | Anderson | |
| 5,673,491 | A * | 10/1997 | Brenna et al. | 33/366.24 |
| 6,050,770 | A | 4/2000 | Avitan | |
| 6,062,106 | A | 5/2000 | Jackson et al. | |
| 6,098,823 | A | 8/2000 | Yahiaoui | |
| 6,327,526 | B1 * | 12/2001 | Hagan | 701/33 |
| 6,532,830 | B1 * | 3/2003 | Jansen et al. | 73/862.042 |

FOREIGN PATENT DOCUMENTS

| | | | |
|---|---|---|---|
| DE | 1 028 310 | 4/1958 | |
| DE | 1 160 150 | 12/1963 | |
| DE | 2616951 | * 10/1977 | 212/278 |
| DE | 3937760 | * 7/1990 | 212/278 |

(Continued)

OTHER PUBLICATIONS

Soviet Inventions Illustrated, "Automatic Overload Anti-Tipping Protective Device for Jib Cranes", Mar. 1966 and SU 173 393.

*Primary Examiner*—Thomas J. Brahan
(74) *Attorney, Agent, or Firm*—Nixon & Vanderhye P.C.

(57) ABSTRACT

A stability measurement system is provided for a lifting vehicle including a vehicle frame, a turntable secured to the vehicle frame and supporting lifting components of the vehicle frame, and a turntable bearing disposed between the vehicle frame and the turntable. The stability measurement system includes a plurality of load sensors secured to the turntable bearing that measure vertical forces on the turntable bearing. A controller calculates a rotational moment applied to the vehicle frame from the turntable by processing the vertical forces on the turntable bearing measured by the plurality of load sensors. The forces are directly related to the stability of the machine. By monitoring the resulting moment according to a predetermined upper bound and lower bound, operation of the lifting machine can be controlled to substantially eliminate a tipping hazard.

14 Claims, 3 Drawing Sheets

FOREIGN PATENT DOCUMENTS

EP 186 860 * 7/1986

JP 8-170935 * 7/1996

* cited by examiner

OVERTURNING MOMENT MEASUREMENT SYSTEM

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The present invention relates to stability in industrial lifting machines and, more particularly, to a measurement system for a lifting vehicle for assessing machine stability.

As a boom is extended and a load is applied to the platform or bucket thereof, the vehicle or lift structure's center of mass moves outwardly toward the supporting wheels, tracks, outriggers or other supporting elements being used. If a sufficient load is applied to the boom, the center of mass will move beyond the wheels or other supporting elements and the vehicle lift will tip over.

In the context of boom lifts, two types of stability are generally addressed, namely "forward" and "backward" stability. "Forward" stability refers to that type of stability addressed when a boom is positioned in a maximally forward position. In most cases, this will result in the boom being substantially horizontal. On the other hand, "backward" stability refers to that type of stability addressed when a boom is positioned in a maximally backward position (at least in terms of the lift angle). This situation occurs when a boom is fully elevated, and the turntable is swung in the direction where the turntable counterweight contributes to a destabilizing moment. In most cases, this will result in the boom being close to vertical, if not completely so.

Typically, not only can a boom be displaced (i.e., pivoted) through a vertical plane, but also through a horizontal plane. In a boom lift, for example, horizontal positioning is usually effected via a turntable that supports the boom. The turntable, and all components propelled by it (including the boom and work platform), are often termed the "superstructure." As the wheeled chassis found in typical lift arrangements will usually not exhibit complete circumferential symmetry of mass, it will be appreciated that there exist certain circumferential positions of the boom that are more likely to lend themselves to potential instability than others. Thus, in the case of a lift in which the chassis or other main frame does not exhibit symmetry of mass with regard to all possible circumferential positions of the boom, then a greater potential for instability will exist, for example, along a lateral direction of the chassis or main frame, that is, in a direction that is orthogonal to the longitudinal lie of the chassis or main frame (assuming that the "longitudinal" dimension of the chassis or main frame is defined as being longer than the "lateral" dimension of the chassis or main frame). Thus, when incorporating safety requirements into the lift, these circumferential positions of maximum potential instability must be taken into account.

A more detailed discussion of lift machine stability can be found in U.S. Pat. No. 6,098,823, the content of which is hereby incorporated by reference.

Stability problems can also arise due to operator improper operation or misuse, for example, if an operator attempts to lift extra weight and exceeds the machine capacity. When overloaded, the loss of machine stability could lead to the machine tipping over. Improper operation or misuse could also arise if an operator gets the machine stuck in the mud, sand, or snow and proceeds to push himself out by telescoping the boom and pushing into the ground. This also leads, in addition to possible structural damage and malfunctioning of the machine, to a tipping hazard. Still another example of improper operation or misuse could occur if an operator lifts a part of the boom onto a beam or post and continues to try to lift. The result is similar to the overloading case.

The use of stability limiting and warning systems in load bearing vehicles has been practiced for several years. Most have been in the form of envelope control. For example, given the swing angle, boom angle, and boom length, a conservative envelope stability system could be developed for a telescopic boom lift or crane. In this method, the number of sensors necessary to achieve the stability measurement is high and contributes to poor reliability and increased cost, especially for machines with articulating booms. In addition, the load in the platform needs to be independently monitored. Another practiced method is to measure boom angle and lift cylinder pressure. In theory, as the load increases, the pressure in the cylinder supporting the boom also increases. But in reality, it is more complicated. Indeed at high angles, for example, much of the load passes into the boom mounting pins and will not result in an appropriate increase in cylinder pressure. Also, hysterisis errors are significant, where the pressures may substantially differ for the same boom angle depending on whether the boom angle was reached by raising or lowering the boom.

Several other similar methods can also be found on the market. However, similar to the methods described above, they use a large number of sensors and lack the ability to address backward stability situations.

BRIEF SUMMARY OF THE INVENTION

The tipping moment of a boom lift vehicle or other lifting vehicle is measured by resolving the forces applied to the frame of the vehicle from the turntable. These forces are directly related to the stability of the machine. Using an upper and lower bound on the resulting moment, when the measured moment is close to the upper bound, for example, the machine is close to forward instability, and when the measured moment is close to the lower bound, the machine is close to backward instability.

According to the present invention, measuring the forces applied to the frame of the vehicle from the turntable is accomplished by supporting the turntable with a plurality of force sensors. Preferably, the turntable is supported by three load pins inserted into a ring that is placed between the frame and the turntable. The load pins measure the vertical forces placed upon them by various turntable positions, boom positions, basket loads, external loads, etc. Through a simple algorithm, moment and swing angle are computed.

In an exemplary embodiment of the invention, a stability measurement system is provided for a lifting vehicle including a vehicle frame, a turntable secured to the vehicle frame and supporting lifting components of the lifting vehicle, and a turntable bearing disposed between the vehicle frame and the turntable. The stability measurement system includes a plurality of load sensors secured to the turntable bearing, the load sensors measuring vertical forces on the turntable bearing, and a controller communicating with the plurality of load sensors. The controller calculates a rotational moment applied to the vehicle frame from the turntable by processing the vertical forces on the turntable bearing measured by the plurality of load sensors. The system preferably includes three load sensors placed about a periphery of the turntable bearing at 120° intervals. The controller calculates the rotational moment based on relative vertical forces measured by the load sensors. The three load sensors include a first load sensor having output ($P_1$), a second load sensor having output ($P_2$) and a third load sensor having output ($P_3$), wherein the controller calculates the rotational moment (M) according to the relation:

$$M = -\frac{\sqrt{3}}{2}R(P_2 - P_3)\sin\theta + \frac{1}{2}R(-2P_1 + P_2 + P_3)\cos\theta,$$

where R is a radius of a circle intersecting the load cells and θ is the turntable swing angle.

Additionally, the turntable swing angle can be determined by:

$$\theta \arctan\left[\frac{\sqrt{3}(P_2 - P_3)}{2P_1 - P_2 - P_3}\right].$$

In another exemplary embodiment of the invention a lifting vehicle includes a vehicle frame, a turntable secured to the vehicle frame and supporting lifting components of the vehicle, a turntable bearing disposed between the vehicle frame and the turntable, and the stability measurement system of the invention. In still another exemplary embodiment of the invention, a method is provided for measuring stability in a lifting vehicle.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
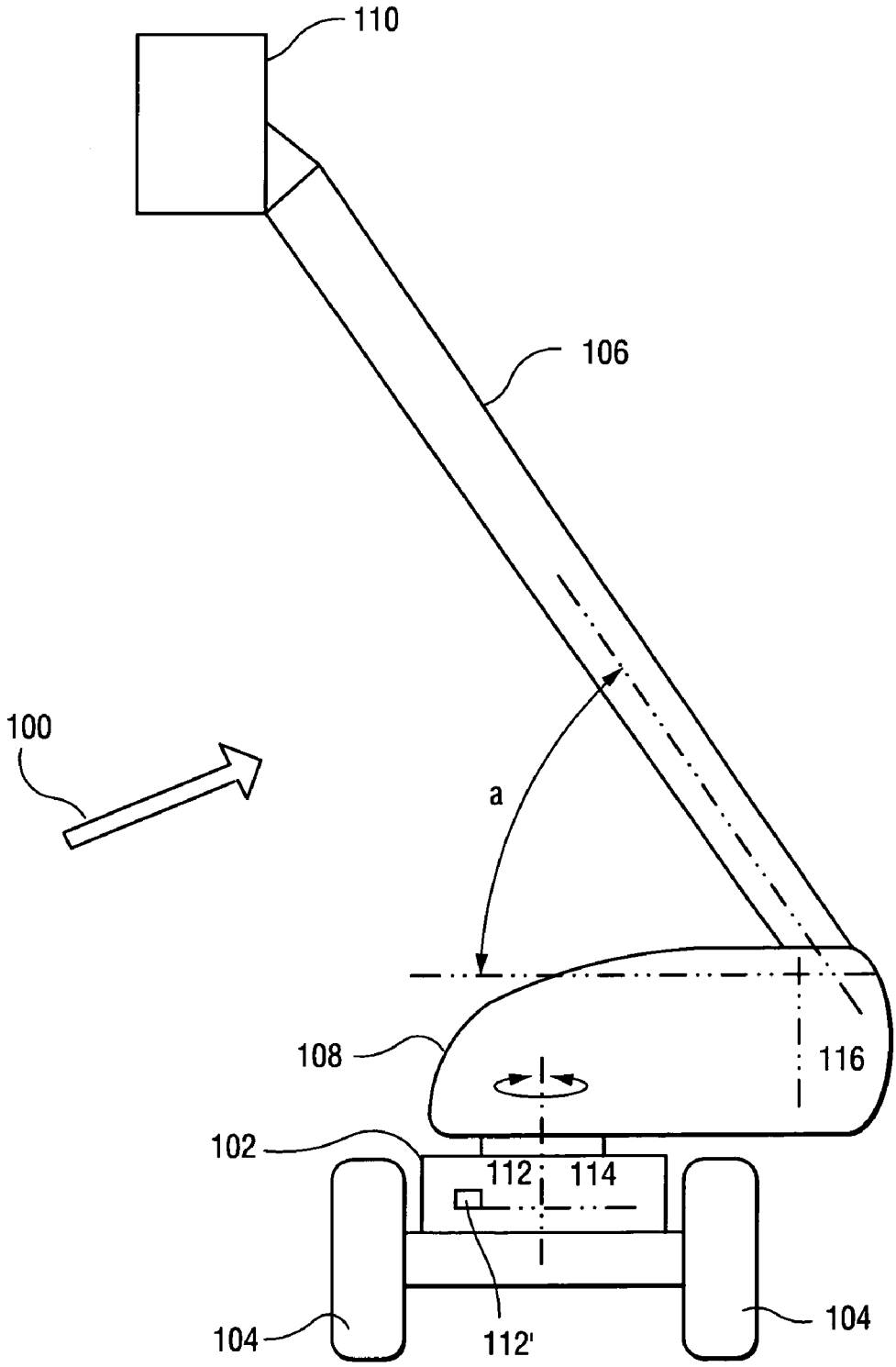
FIG. 1 is a schematic representation of a lifting vehicle and associated components.

FIG. 1 schematically illustrates a typical boom lift 100 that might employ the present invention in accordance with at least one presently preferred embodiment. As is known conventionally, a chassis 102 is supported on wheels 104. Conceivable substitutes for wheels 104 might be tracks, skids, outriggers or other types of fixed or movable support arrangements. A boom 106, extending from turntable 108, will preferably support at its outer end a platform 110. Turntable 108 may preferably be configured to effect a horizontal pivoting motion, as indicated by the arrows, in order to selectively position the boom 106 at any of a number of circumferential positions lying along a horizontal plane. There is preferably a drive arrangement 112 (such as a slew or swing drive) to effect the aforementioned horizontal pivoting motion. On the other hand, there is also preferably provided a drive arrangement 114 (such as a lift cylinder) for pivoting the boom 106 along a generally vertical plane, to establish the position of boom 106 at a desired vertical angle a. The drive arrangements 112 and 114 could be operationally separate from one another or could even conceivably be combined into one unit performing both of the aforementioned functions. As mentioned previously, the turntable 108 and all components propelled by it (including the boom 106 and platform 110) are often termed the "superstructure."

Preferably, the turntable 108 will include, in one form or another, a counterweight 116. The concept of a counterweight is generally well known to those of ordinary skill in the art. Preferably, the counterweight 116 will be positioned, with respect to the turntable 108, substantially diametrically opposite the boom 106.

Figure 2:
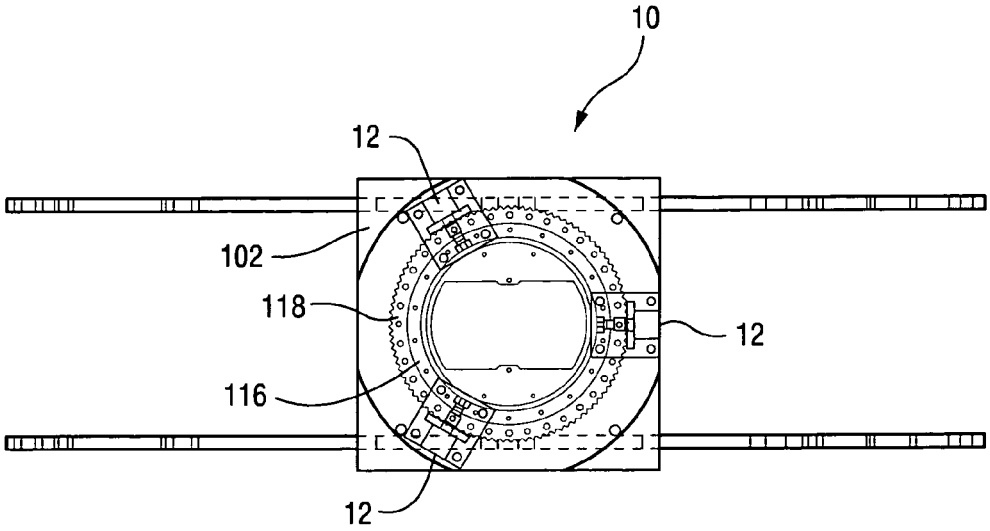
FIG. 2 is a plan view of a vehicle frame and turntable with the measurement system according to the present invention.

Referring to FIG. 2, the measurement system 10 according to the present invention includes a plurality of load sensors 12 secured to a turntable bearing 118 disposed between the vehicle chassis or frame 102 and the turntable 116. As shown, the measurement system 10 includes three load sensors 12 that are placed about a periphery of the turntable bearing 118 at 120° intervals. Additional or fewer load sensors 12 may be alternatively used for calculating a rotational moment applied to the vehicle frame, and the invention is not necessarily meant to be limited to the three load sensors shown. Additionally, the load sensors 12 need not necessarily be positioned equidistant about the periphery of the turntable bearing 118. The turntable is typically attached to the bearing at several points (typically, via twenty-four bolts). For economic and other reasons, it is preferable to minimize the number of load pins or load cells, with the preferable minimum number to be used being three. By doing so, in order to maintain the bearing specifications on maximum allowable deflection, a structural ring may be added to take all the additional deflection introduced by the substantially lower number of attachments (i.e., three load sensors 12 versus twenty-four attachment bolts).

Figure 3:
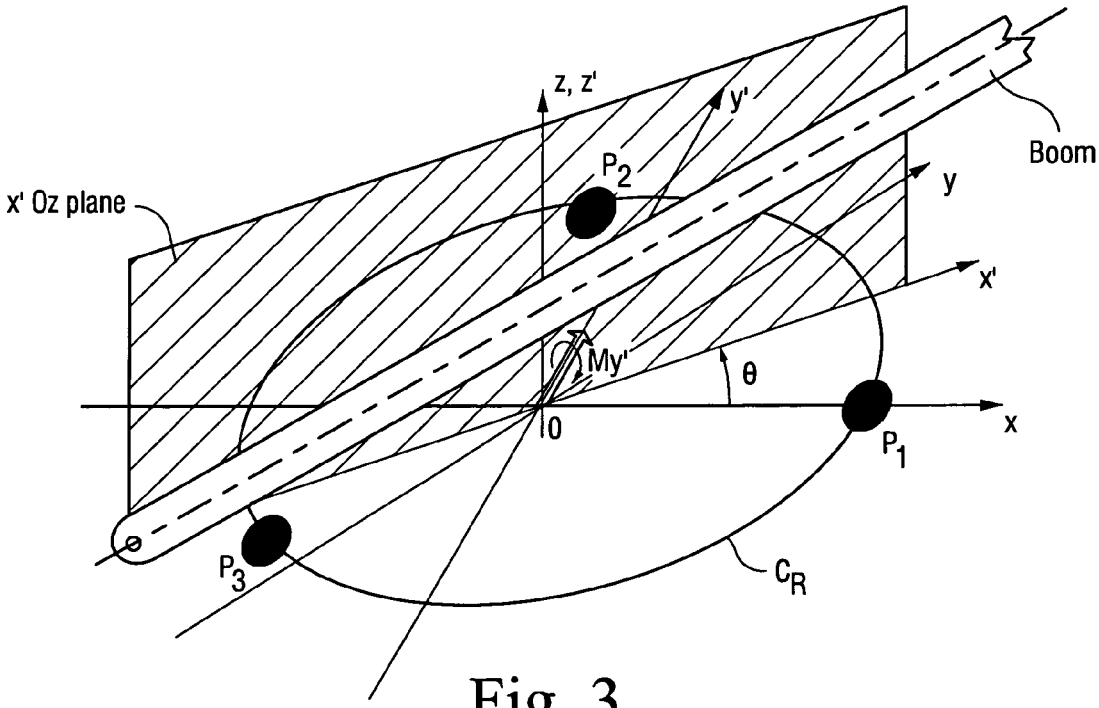
FIGS. 3–5 illustrate an application of the control algorithm to determine the rotational moment on the vehicle frame.
Figure 4:
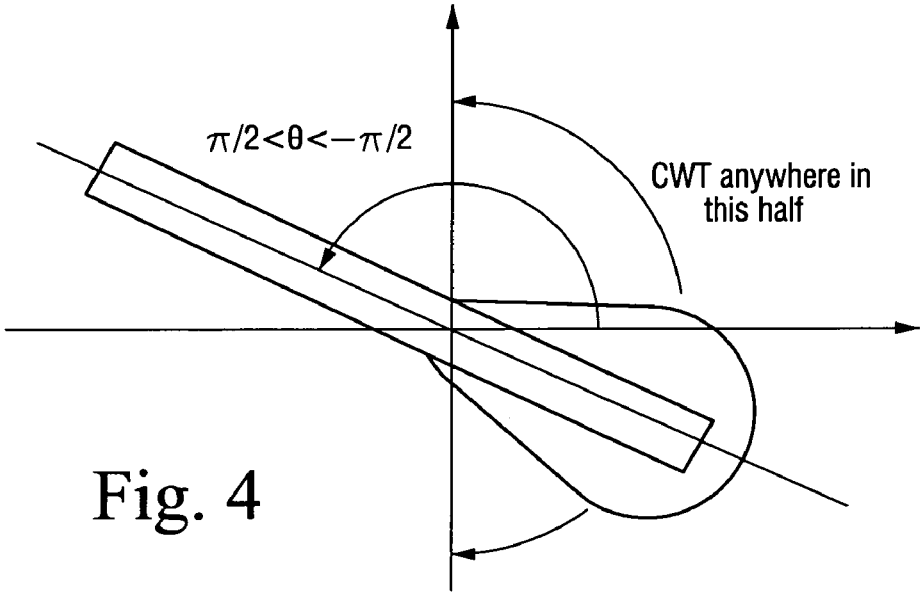
Figure 5:
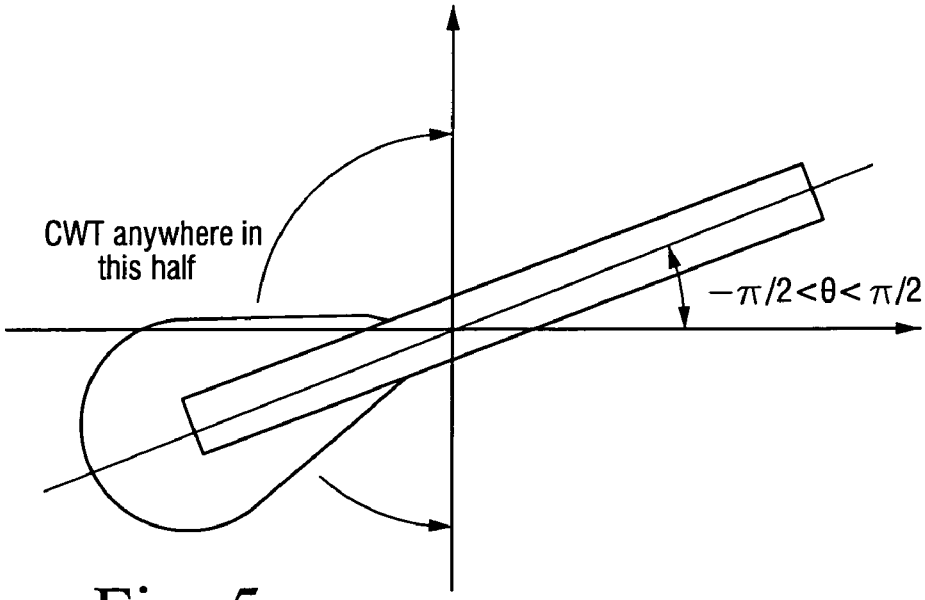

The load sensors 12 measure vertical forces on the turntable bearing 118. Any suitable load sensors that can measure a vertical load according to relative parts may be used. An example of a suitable load sensor is the 5100 Series Load Pin available from Tedea-Huntleigh International, Ltd., of Canoga Park, Calif. The sensors 12 communicate with a controller 112', which communicates with the vehicle drive arrangement, and the controller 112' calculates a rotational moment applied to the vehicle frame 102 from the turntable 116 by processing vertical forces on the turntable bearing 118 measured by the load sensors 12. In this context, the controller 112' calculates the rotational moment based on relative vertical forces measured by the load sensors. With reference to FIGS. 3–5, an exemplary formula for calculating the rotational moment on the vehicle frame 102 based on the vertical forces on the turntable bearing 118 measured by the load sensors 12 can be expressed as follows:

$$\phi = \arctan\left[\frac{\sqrt{3(P_2 - P_3)}}{2P_1 - P_2 - P_3}\right],$$

and

θ=ø or ø+π (depending on location of counterweight 116), where $$M = -\frac{\sqrt{3}}{2}R(P_2 - P_3)\sin\theta + \frac{1}{2}R(-2P_1 + P_2 + P_3)\cos\theta,$$

where M is the rotational moment on the vehicle frame 102 based on vertical forces on the turntable, R is the radius of a circle $C_R$ intersecting the three load sensors, $P_1$–$P_3$ are the load cell readings on the turntable, and θ is the turntable swing angle.

Because the system can determine the swing angle from the load sensor readings, it is therefore relatively easy to have a better stability envelope with no need of additional sensors to measure the swing angle. Rather, the orientation of the boom (over front side or over rear side of chassis) can be sensed by utilizing the currently existing limit switch for the oscillating axle lock-out system. Lifts with no oscillating axle can be fitted with a similar simple switch system.

The resulting moment can be used to assess the stability of the machine and control operation of the machine components. In operation, an upper bound and a lower bound for the resulting moment are set based on characteristics of the machine (e.g., boom length, height, weight, swing angle, etc.). The upper and lower bounds can be determined experimentally or may be theoretical values. When the measured moment is close to the upper bound, the machine is close to forward instability. When the measured moment is close to the lower bound, the machine is close to backward instability. As the machine approaches forward or backward instability, operation of the machine can be controlled via the controller 112' to prevent the resulting moment from surpassing the upper or lower bounds.

In addition to calculating the rotational moment applied to the frame through the turntable, the load sensors 12 can be used to derive the load in the platform by:

$$\text{Load}=P_1+P_2+P_3-W,$$

where W is a constant and known weight of the upper structure including, e.g., boom platform, control box. Still further, by mounting the load sensors 12 to the turntable bearing 118, the system can also account for external forces on the boom or the like that may affect stability. Conventionally, only the load in the platform is monitored. These conventional systems therefore cannot accommodate stability variations that may be caused by the boom or platform colliding with an external object, such as a beam or the like or even the situation when the boom itself is used to lift the vehicle or something other than a load in the platform.

With the system according to the present invention, a boom lift or other lifting vehicle can be operated more safely by monitoring a rotational moment applied to the vehicle frame from the turntable according to vertical forces on a turntable bearing. As a consequence, a tipping hazard can be reduced or substantially eliminated. By monitoring the moment in this manner, the system of the invention can accurately and continuously assess true forward and backward tipping moments. As a result, the system can effect a continuous rated capacity as opposed to the current dual rating (such as fully extended, fully retracted). In addition, the upper and lower bounds can enable continuously more capacity with decreasing ground slope (using a chassis tilt monitor), and continuously more capacity from boom over the side to boom over front/back (conventionally, only rated for worse configuration - boom over the side). By monitoring the load applied to the frame from the turntable, the system can detect imminent tipping due to external forces, other than load in the platform. Design requirements can be relaxed, and machines can be pre-programmed for different reach and capacity. The system can derive/determine the load in the basket, thereby helping to prevent structural overload of basket attachments and the leveling system. By monitoring moments and weight in the basket, the system can be used to store information about occurrences of excessive loads, which information can be used when responding to warranty claims.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A stability measurement system for a lifting vehicle including a vehicle frame, a turntable secured to the vehicle frame and supporting lifting components of the lifting vehicle, and a turntable bearing disposed between the vehicle frame and the turntable, the stability measurement system comprising:

a plurality of load sensors secured to the turntable bearing, the load sensors measuring vertical forces on the turntable bearing by the turntable, the lifting components and any load, wherein the load sensors comprise load pins connecting the vehicle frame and the turntable via the turntable bearing; and a controller communicating with the plurality of load sensors, the controller calculating a rotational moment applied to the vehicle frame from the turntable by processing the vertical forces on the turntable bearing measured by the plurality of load sensors to thereby assess at least forward and backward stability.

2. A stability measurement system according to claim 1, comprising three load sensors placed about a periphery of the turntable bearing at 120° intervals.

3. A stability measurement system according to claim 2, wherein the controller calculates the rotational moment based on relative vertical forces measured by the load sensors.

4. A stability measurement system according to claim 3, wherein the three load sensors comprise a first load sensor having output ($P_1$), a second load sensor having output ($P_2$) and a third load sensor having output ($P_3$), and wherein the controller calculates the rotational moment (M) according to the relation:

$$M = -\frac{\sqrt{3}}{2}R(P_2 - P_3)\sin\theta + \frac{1}{2}R(-2P_1 + P_2 + P_3)\cos\theta,$$

where R is a radius of a circle intersecting the load cells and θ is the turntable swing angle.

5. A stability measurement system according to claim 4, wherein the turntable swing angle (θ) is determined according to the relation:

$$\theta = \arctan\left[\frac{\sqrt{3}\,(P_2 - P_3)}{2P_1 - P_2 - P_3}\right].$$

6. A stability measurement system according to claim 1, wherein the controller calculates a turntable swing angle based on the vertical forces on the turntable bearing.

7. A lifting vehicle comprising:

a vehicle frame;

a turntable secured to the vehicle frame and supporting lifting components of the vehicle;

a turntable bearing disposed between the vehicle frame and the turntable; and a stability measurement system comprising:

a plurality of load sensors secured to the turntable bearing, the load sensors measuring vertical forces on the turntable bearing, wherein the load sensors comprise load pins connecting the vehicle frame and the turntable via the turntable bearing; and a controller communicating with the plurality of load sensors, the controller calculating a rotational moment applied to the vehicle frame from the turntable by processing the vertical forces on the turntable bearing measured by the plurality of load sensors to thereby assess at least forward and backward stability.

8. A lifting vehicle according to claim 7, wherein the stability measurement system comprises three load sensors placed about a periphery of the turntable bearing at 120° intervals.

9. A lifting vehicle according to claim 8, wherein the controller calculates the rotational moment based on relative vertical forces measured by the load sensors.

10. A lifting vehicle according to claim 9, wherein the three load sensors comprise a first load sensor having output ($P_1$), a second load sensor having output ($P_2$) and a third load sensor having output ($P_3$), and wherein the controller calculates the rotational moment (M) according to the relation:

$$M = -\frac{\sqrt{3}}{2}R(P_2 - P_3)\sin\theta + \frac{1}{2}R(-2P_1 + P_2 + P_3)\cos\theta,$$

where R is a radius of a circle intersecting the load cells and θ is the turntable swing angle.

11. A lifting vehicle according to claim 10, wherein the turntable swing angle (θ) is determined according to the relation:

$$\theta = \arctan\left[\frac{\sqrt{3}(P_2 - P_3)}{2P_1 - P_2 - P_3}\right].$$

12. A lifting vehicle according to claim 7, wherein the controller calculates a turntable swing angle based on the vertical forces on the turntable bearing.

13. A method of measuring stability in a lifting vehicle including a vehicle frame, a turntable secured to the vehicle frame and supporting lifting components of the lifting vehicle, and a turntable bearing disposed between the vehicle frame and the turntable, the method comprising:

connecting the vehicle frame and the turntable with a plurality of load pins secured to the turntable bearing;

measuring vertical forces on the turntable bearing by the turntable, the lifting components and any load with the plurality of load pins; and calculating a rotational moment applied to the vehicle frame from the turntable by processing the vertical forces on the turntable bearing measured by the plurality of load pins and thereby assessing at least forward and backward stability.

14. A method according to claim 13, further comprising calculating a turntable swing angle based on the vertical forces on the turntable bearing.

* * * * *